US009022094B2

(12) United States Patent
Kotani et al.

(10) Patent No.: US 9,022,094 B2
(45) Date of Patent: May 5, 2015

(54) CASTING CORE, METHOD FOR PRODUCING SAME, AND METHOD FOR CASTING USING SAID CORE

(71) Applicant: Suzuki Motor Corporation, Shizuoka-Ken (JP)

(72) Inventors: Takafumi Kotani, Shizuoka-Ken (JP); Yuichi Mizumura, Shizuoka-Ken (JP); Hikotaro Suzuki, Shizuoka-Ken (JP); Masaya Nomura, Shizuoka-Ken (JP)

(73) Assignee: Suzuki Motor Corporation, Hamamatsu-Shi, Shizuoka-Ken (JP)

( * ) Notice: Subject to any disclaimer, the term of this patent is extended or adjusted under 35 U.S.C. 154(b) by 0 days.

(21) Appl. No.: 14/352,765

(22) PCT Filed: Oct. 10, 2012

(86) PCT No.: PCT/JP2012/076202
§ 371 (c)(1),
(2) Date: Apr. 18, 2014

(87) PCT Pub. No.: WO2013/058152
PCT Pub. Date: Apr. 25, 2013

(65) Prior Publication Data

US 2014/0251571 A1 Sep. 11, 2014

(30) Foreign Application Priority Data

Oct. 19, 2011 (JP) ..... 2011-230033

(51) Int. Cl.

| | |
|---|---|
| ***B22D 29/00*** | (2006.01) |
| ***B22C 9/10*** | (2006.01) |
| ***B22C 3/00*** | (2006.01) |
| ***B22C 1/02*** | (2006.01) |

(52) U.S. Cl.
CPC ..... *B22D 29/002* (2013.01); *B22C 9/105* (2013.01); *B22C 9/10* (2013.01); *B22C 3/00* (2013.01); *B22C 1/02* (2013.01)

(58) Field of Classification Search
CPC ..... B22C 1/02; B22C 3/00; B22C 9/105; B22C 9/10; B22D 29/002
See application file for complete search history.

(56) References Cited

U.S. PATENT DOCUMENTS 3,407,864 A 10/1968 Anderko et al.

FOREIGN PATENT DOCUMENTS

| | | | |
|---|---|---|---|
| JP | 464817 | B1 | 2/1971 |
| JP | 4948612 | B1 | 12/1974 |
| JP | H04111940 | A | 4/1992 |
| JP | 2005131664 | A | 5/2005 |
| JP | 2006007234 | A | 1/2006 |
| JP | 2007144460 | A | 6/2007 |
| JP | 2007296566 | A | 11/2007 |
| JP | 2010227977 | A | 10/2010 |

OTHER PUBLICATIONS

Search Report for International Patent Application No. PCT/JP2012/076202; Dec. 25, 2012.
English Translation of International Preliminary Report on Patentability and Written Opinion of the International Search Authority for International Patent Application No. PCT/JP2012/076202 dated Oct. 10, 2012.

*Primary Examiner* — Kevin P Kerns
*Assistant Examiner* — Steven Ha
(74) *Attorney, Agent, or Firm* — Barnes & Thornburg LLP

(57) ABSTRACT

A casting core resulting from alkaline earth metal oxide particles having an average particle size of 0.8-4 mm being dispersed in a water-soluble alkali metal salt matrix. The casting core can be efficiently produced using a method of dispersing alkaline earth metal hydroxide particles having favorable disintegration properties and a particle size in the range of 1-5 mm in a molten water-soluble alkali metal salt, converting to alkaline earth metal oxide particles by means of dehydration, and casting in a mold, cooling, and hardening.

10 Claims, No Drawings

CASTING CORE, METHOD FOR PRODUCING SAME, AND METHOD FOR CASTING USING SAID CORE

PRIORITY CLAIM

This patent application is a U.S. National Phase of International Patent Application No. PCT/JP2012/076202, filed 10 Oct. 2012, which claims priority to Japanese Patent Application No. 2011-230033, filed 19 Oct. 2011, the disclosures of which are incorporated herein by reference in their entirety.

TECHNICAL FIELD

The present invention relates generally to the casting method, such as die-casting, and more particularly, to a technology of efficiently manufacturing a core having improved collapsibility for use therein, and a casting method using the core.

BACKGROUND ART

In a die-casting process for fabricating a cast product having a complicated internal shape, a core is used. As a core used for such a die-casting process, there have been developed water-soluble cores, which are formed of salts, etc., and, after the casting, are removed from the cast products by dissolution with water (Patent documents 1-3).

In the case of the die-casting process using such a water-soluble core, especially in the case of performing the die-casting process at a high pressure, the velocity of the molten metal at the time of casting becomes large and also a high impact force is applied to the water-soluble core, so that a high strength is required of the water-soluble core. Accordingly, the reinforcement of the water-soluble core has been practiced but, if the water-soluble core is provided with an enhanced strength, the water-soluble core is liable to have inferior collapsibility required for removal thereof from the cast product.

Various methods have been proposed in order to promote collapse of water-soluble cores which are principally composed of soluble constituents, such as salts. For example, there has been proposed a method, wherein alkaline earth metal compound powder, such as quicklime (calcium oxide) or magnesium oxide, is admixed within an alkali metal salt as a main core component to form a water-soluble core, which is contacted with water after the casting of a metal to cause the expansion of the alkaline earth metal compound powder with water to promote the collapsibility of the water-soluble core (Patent document 4). However, according to a study of the present inventors, the addition of such an alkaline earth metal compound failed in a desired improvement in collapsibility but rather resulted in difficulties, such as inferior moldability (castability) of the core.

PRIOR ART DOCUMENTS

Patent Documents

[Patent document 1] JP-A 2005-131664,
[Patent documents 2] JP-A 2007-144460,
[Patent document 3] JP-A 2007-296566,
[Patent documents 4] JP-A 2006-7234.

SUMMARY OF THE INVENTION

Problems to be Solved by the Invention

Therefore, principal objects of the present invention are to provide a water-soluble core with improved collapsibility, an efficient process for production thereof, and further an efficient casting method using the core.

Means for Solving the Problems

As a result of further study of the present inventors, it has been found very effective for achieving the above-mentioned objects to disperse an alkaline earth metal oxide which has been used in a powdery state as collapse accelerator after size-enlargement to particles with appropriate particle sizes, in an alkali-metal-salt matrix, thereby utilizing a state change through interaction with water and a relative state change with respect to the alkali-metal-salt matrix. More specifically, according to the present invention, there is provided a casting core, comprising: a water-soluble alkali metal salt matrix, and alkaline earth metal oxide particles having an average particle size of 0.8-4 mm dispersed in the alkali metal salt matrix.

A brief history through which the present inventors have arrived at the present invention as a result of study with the above-mentioned objects, will be described. It is considered that the alkaline earth metal oxide has been conventionally used in a powdery state as a collapse accelerator because it has been concerned that the alkaline earth metal oxide in a particle state dispersed in the alkali metal salt matrix is liable to result in roughness defects in the casting surface formed by solidification of the molten metal while contacting the core. According to the present inventors' tests, however, it has been discovered that the alkaline earth metal oxide particles added as collapse accelerator do not cause noticeable roughness defects in the casting surface as far as they have an average particle size (a volume-average particle diameter in terms of the Stokes nominal diameter according to the sedimentation method (JIS Z8901) is meant herein unless otherwise noted specifically) up to about 4 mm but rather the thus-increased particle size provides the following advantageous effects. (a) On contacting water, the alkaline earth metal oxide particles absorb one molecule of water and change into alkali earth metal hydroxide, while causing a lowering in specific gravity by 20 to 50% and correspondingly an increase in particle size by 8 to 20% to crack the alkali metal salt matrix and accelerate the collapse of the core in contact with water, and this effect is increased at a lager particle size. (b) The moldability (castability) of a core is lowered due to viscosity increase of the melt of matrix alkali metal salt if the amount of addition of powdery alkaline earth metal oxide is increased. However, if the alkaline earth metal oxide particles are used in an increased amount, the collapsibility can be enhanced without impairing the moldability so much, since the increase in surface area directly contributing to viscosity increase is suppressed due to their particle form.

The casting core of the present invention can also be formed by directly using alkaline earth metal oxide particles having an average particle size of 0.8-4 mm as a raw material. It is however preferred to use alkali earth metal hydroxide particles having a little larger particle size as a precursor. More specifically, The process for producing a casting core according to the present invention is characterized by comprising: dispersing alkaline earth metal hydroxide particles having particle sizes in a range of 1-5 mm in a melt of a water-soluble alkaline metal salt to convert them into alkaline earth metal oxide particles by dehydration, and then casting the melt into a mold to cool and solidify the melt. The alkaline earth metal hydroxide particles as a precursor lose one molecule of water at 350-800° C. which is lower than about 400-1100° C. as a melting point of a water-soluble alkaline metal salt to contract a little to be converted into alkaline earth metal oxide particles of a little smaller particle size, thus forming an effective collapse accelerator. By using an alkali earth metal hydroxide as a precursor and without directly using alkaline earth metal oxide particles, efficient particle formation becomes possible through solidification with water and crushing, while preventing fine powder formation.

Moreover, the present invention also provides an efficient casting method using the above-mentioned casting core, more specifically, a casting method, comprising: casting a molten metal into a mold in which the above-mentioned casting core of the present invention has been disposed, cooling and solidifying the molten metal to form a cast metal object enclosing therein the casting core, taking out the cast metal object out of the mold, and causing the core to contact the water to cause an expansion of the alkaline earth metal oxide particles due to conversion thereof into alkaline earth metal hydroxide particles and cause cracks in the alkali metal salt, thereby accelerating collapse and dissolution with the water of the casting core, and recovering cast metal object.

EMBODIMENTS OF THE INVENTION

Hereinafter, the casting core of the present invention is explained in order mainly with reference to embodiments of the production process of the present invention which is a preferred process for production of the casting core.

(Water-soluble Alkali Metal Salt)

A principal component of the casting core of the present invention is a water-soluble alkali metal salt which forms a matrix of the core. Preferred examples thereof may include at least one species of the chloride, nitrate and sulfate of sodium and/or potassium. These water-soluble alkali metal salts may two or more species thereof for providing a lower melting point if needed. An especially preferred example thereof may be a mixture of sodium chloride (melting point: about 800° C.) and potassium chloride (melting point: about 776° C.) (for example, an about 55:45 (weight ratio) mixture (=about 0.6:=0.4 (molar ratio) mixture) will provide a melting point of 672° C.). These water-soluble alkali metal salts are generally supplied in in a powdery form, but the particle size thereof is not particularly restricted since they are used in a molten state.

(Alkaline Earth Metal Hydroxide)

Although alkaline earth metal oxide particles are dispersed as a collapse accelerator in the water-soluble alkali metal salt matrix in the casting core of the present invention, they may preferably be formed through alkaline earth metal hydroxide particles by the process of the present invention, as mentioned above. Alkaline earth metal hydroxides may generally include hydroxides of beryllium (Be), magnesium (Mg), calcium (Ca), strontium (Sr), and barium (Ba), but magnesium hydroxide (Mg(OH)2), calcium hydroxide (Ca(OH)2) and barium hydroxide (Ba(OH)2) are preferably used because of no toxicity and chemical stability. If these hydroxides are heated at 350° C. or more, 580° C. or more, and 408° C. or more, respectively, i.e., disposed in the melt of the water-soluble alkali metal salt prepared so as to have a melting point of about 400-1000° C., they lose one molecule of water to be converted into magnesium oxide (MgO; melting point: 2852° C.), a calcium hydroxide (CaO; melting point: 2570° C.), and barium hydroxide (BaO; melting point: 1918° C.), respectively, and are dispersed as particles thereof in the melt.

These alkali earth metal hydroxides are generally commercially available in a powder form having a particle size of about 100-200 μm but may preferably be supplied to the process of the invention after size enlargement to particle sizes in a range of 1-5 mm. The method of the size enlargement is arbitrary, and it may be possible to adopt a method of agglomerating powder which has been made tacky by spraying of mist-like water. More preferably, however, it is preferred to adopt a method of adding water to alkali earth metal hydroxide or oxide and mixing until it becomes paste state, followed by drying, solidifying and suitable level of crushing, and further sieving to adjust a particle size in order to obtain dense alkaline earth metal hydroxide particles having uniform particle sizes and free from fine powder. As a crushing means, arbitrary primary crushers or secondary crushers may be used, and it is also possible to use a metal hammer or a wood hammer, also as a convenient means with few developments of fines. Sieving may be performed by using, e.g., JIS standard sieves (JIS Z8801-1982) for recovering particles on 1 mm-opening sieve and under about 5 mm-opening sieve (more specifically under 5.66 mm- or 4.76 mm-opening sieve), preferably under 4 mm-opening sieve, to obtain alkaline earth metal hydroxide particles having particle sizes in a desirable range.

The alkaline earth metal hydroxide particles may preferably be used in an amount of at most 40 wt. parts, particularly 23-31 wt. parts, per 100 wt. parts of the alkali metal salt. Too small an amount leads to scarce effect of accelerating the collapse of the core, and an excessive amount leads to inferior castability. In the core obtained as a result, the alkaline earth metal oxide particles are dispersed in a weight of 10 to 30% less (e.g., 24% decrease in the case of Ca(OH)2→CaO) than that of the alkaline earth metal hydroxide particles used.

(Refractory Particles Other Than Alkaline Earth Metal Oxides)

In the casting core of the present invention, in addition to the above-mentioned alkaline earth metal oxide, refractory particles other than alkaline earth metal oxide particles, such as those of silica, alumina, and mullite, can be added for the purpose of raising the strength of the core. The refractory particles added for the purpose may preferably have an average particle size of 1.0 mm or less, and at most 40 μm. Further, the amount of addition thereof may preferably be at most 50 wt. parts, desirably in the range of 32 to 44 wt. parts, per 100 wt. parts of the water-soluble alkali metal salt. Addition in excess of 50 wt. parts will result in inferior castability.

(Production of the Core)

For production of the casting core according to the process of the present invention, the alkaline earth metal hydroxide particles obtained in the above-described manner are dispersed in the melt of the water-soluble alkali metal salt, to be transformed into alkaline earth metal oxide particles. This can be effected by simply adding alkaline earth metal hydroxide particles into the melt of the water-soluble alkali metal salt formed beforehand. However, in order to acquire a better dispersion state, it is preferred to adopt a method of obtaining a blend of the water-soluble alkali metal salt, the above-prepared alkaline earth metal hydroxide particles and optionally added other additives, such as refractory particles, and heating the blend in a furnace to melt the water-soluble alkali metal salt, thereby forming a state wherein the alkaline earth metal hydroxide particles are dispersed in the melt and dehydrated into alkaline earth metal oxide particles, which are consequently dispersed in the melt of the water-soluble alkali metal salt. As mentioned above, the melting point of alkali metal salt can be adjusted to about 400-1000° C, which is higher than 350-600° C. as dehydrating temperatures of ordinary alkali earth metal hydroxides, so that the melt of alkali metal salt containing the alkaline earth metal oxide particles (and other refractory particles) dispersed therein can be usually formed promptly.

Subsequently, the core of the present invention comprising a water-soluble alkaline metal salt with the alkaline earth metal oxide particles dispersed therein as a collapsibility accelerator, may be formed by casting the melt of the alkali metal salt formed above into core mold, followed by cooling, solidification and demolding.

(Casting)

The core of the present invention may be disposed in a mold for die-casting, molten metal is cast in the mold and cooled and solidified therein, and the thus-formed cast metal object enclosing therein the core is taken out of the mold. Then, the core is contacted with water and cracked by expansion due to conversion to alkaline earth metal hydroxide particles of the alkaline earth metal oxide particles, thereby causing accelerated collapse and dissolution of the core, whereby a cast metal product can be recovered. The casting core of the present invention exhibits a high pressure resistance, so that it is suitably applied to pressurization casting of an aluminum alloy, a magnesium alloy, or a brass alloy.

EXAMPLES

Hereinbelow, the present invention will be described more specifically based on Preliminary tests, Examples and Comparative Examples.

<<Preliminary Test>>

[Preparation of a Core]

Cores were prepared from materials shown below.

Water-soluble alkaline metal salt: NaCl:KCl=6:4 (molar ratio) mixture (melting point=about 672° C.); (NaCl, made by Otsuka Chemical Co., Ltd.; KCl, made by Wako Pure Chemical Industries, Ltd.) 100 wt. parts Alkali earth metal hydroxide: Ca(OH)2 powder (average particle size: 150 μm) (made by Maruai Lime Industries, Ltd.): 3 levels of 23 wt. parts, 31 wt. parts and 38 wt. parts.

Other refractory materials.

Cerabead (melting point=about 1825° C., particle size: about 0.2 mm-1.0 mm) ("Naigai CERABEAD 60", made by Naigai Co., Ltd.) 21 wt. parts.

Mullite powder (melting point = about 1750° C.) ("Mullite Flour", made by Inagaki Clay Mining Co., Ltd.) 21 wt. parts.

<Preparation of Alkali Earth Metal Hydroxide Particulate Matter>

Ca(OH)2 powder (1): Ca(OH)2 powder mentioned above was used as it was.

Ca(OH)2 lump (2): Mist-like water was sprayed on the above-mentioned Ca(OH)2 powder, and the resultant sticky aggregates were blended with the other materials (NaCl:KCl mixture, Cerabead, mullite) to form lumps having particle sizes of roughly 3 mm.

Ca(OH)2 lump (3): Mist-like water was sprayed on the above-mentioned Ca(OH)2 powder, and the resultant sticky aggregates were dried to form Ca(OH)2 lumps having particle sizes of roughly 3 mm.

Ca(OH)2 particles (4):—Water was added to the above-mentioned Ca(OH)2 powder and mixed with each other on a tray until the mixture became pasty, followed by drying to form a slate of Ca(OH)2 , which was then crushed by a hammer and a mortar to provide Ca(OH)2 particles having an average particle size of roughly 3 mm.

<Preparation of Cores>

The above prepared 3 species of Ca(OH)2 particulate matter (except for Ca(OH)2 lump (2) which had been already blended with other materials) were each blended with the other raw materials, i.e., NaCl:KCl mixture, Cerabead and the mullite powder. The resultant 12 types of core materials, i.e., 4 types each at 3 Ca(OH)2-addition levels, were respectively heated in a 740° C. furnace, to form melts of alkali metal salts each containing Ca(OH)2 , etc., dispersed therein, which were then each cast in a core-forming mold (SKD 61) at 400° C., followed by solidification and demolding to form cores each having a length of 90 mm and a section of 10 mm-square.

The 12 types of cores obtained above were each subjected to the following evaluations.

(Castability)

Each molten salt was observed with eyes and evaluated with respect to the state thereof when cast into a mold and fluidity thereof into the mold according to the following standard.

A: The molten salt exhibits a very low viscosity and is easily poured into the mold.

B: The molten salt exhibits a viscosity with no problem and can be cast into the mold.

C: The molten salt exhibits a high viscosity but can be cast into the mold.

D: The molten salt exhibits a high viscosity and cannot be cast into the mold.

(Collapsibility)

Each core was immersed in 200 ml of water for 1 hour and observed with respect the collapse state to be evaluated according to the following standard.

A: The core exhibits very good collapsibility and has been half collapsed.

A−: The core is liable to result in an inferior cast product but the cast product, if obtained, gives a half collapsed core showing very good collapsibility.

B: The core has begun to collapse from the surface.

C: The core exhibits minutes surface cracks.

D: A satisfactory core cannot be obtained due to excessively high viscosity for casting.

The results are collectively shown in Table 1 below.

TABLE 1

| | Castability Amount of Ca(OH)2 (wt. parts) | | | Collapsibility Amount of Ca(OH)2 (wt. parts) | | |
|---|---|---|---|---|---|---|
| Ca(OH)2 Species | 23 | 31 | 38 | 23 | 31 | 38 |
| Ca(OH)2 powder (1) | B | D | D | C | D | D |
| Ca(OH)2 lump (2) | B | C | D | B | B | D |
| Ca(OH)2 lump (3) | A | B | D | B | A | D |
| Ca(OH)2 particles (4) | A | A | C | A | A | A− |

Examples and Comparative Examples

Ca(OH)2 particles (4) prepared in the above-mentioned Preliminary test were subjected to sieving through a 1 mm-opening sieve and a 4 mm-opening sieve, as JIS standard sieves (JIS Z8801-1982) and classified into 3 particle fractions of under 1 mm-opening sieve, on 1 mm-opening sieve and under 4 mm-opening sieve, and on 4 mm-opening sieve.

Example 23 wt. parts of the particle fraction of on 1 mm-opening sieve and under 4 mm-opening sieve obtained by sieving of Ca(OH)2 particles (4), 100 wt. parts of the NaCl:KCl mixture used in Preliminary test, 21 wt. parts of cerabead and 21 wt. parts of mullite powder were dry-blended to obtain a particulate core material. The particulate core material was heated in a 740° C. furnace to form an alkali metal molten salt containing Ca(OH)2 particles, etc., dispersed therein, which was then cast into a core-forming mold (SKD61) at 400° C., followed by solidification and demolding to obtain a core having a length of 90 mm and a section of 90 mm-square.

Comparative Example 1

A core was obtained in the same manner as the above-mentioned Example except for using the Ca(OH)2 powder (1) used in the Preliminary test instead of the particle fraction of on 1 mm-opening sieve and under 4 mm-opening sieve obtained by sieving of Ca(OH)2 particles (4).

Comparative Example 2

A core was obtained in the same manner as the above-mentioned Example except for using a particle fraction of under 1 mm-opening sieve instead of the particle fraction of on 1 mm-opening sieve and under 4 mm-opening sieve obtained by sieving of Ca(OH)2 particles (4).

Comparative Example 3

A core was obtained in the same manner as the above-mentioned Example except for using a particle fraction of on 4 mm-opening sieve instead of the particle fraction of on 1 mm-opening sieve and under 4 mm-opening sieve obtained by sieving of Ca(OH)2 particles (4).

<Evaluation>

Each of the cores obtained in the above-mentioned Example and Comparative Examples 1-3, was evaluated with respect to the castability and the collapsibility as in the above-described Preliminary test, and also the surface state of the core reflected in the casting surface (surface finish state) of a cast metal product by observation with eyes.

The results are summarized in the following table.

TABLE 2

| | | Core | | |
|---|---|---|---|---|
| | Particle size of $Ca(OH)_2$ | Castability | Collapsibility | Casting surface |
| Comparative Example 1 | About 150 μm | B | B | A |
| Comparative Example 2 | <1 mm | B | B | A |
| Example | 1 mm-4 mm | A | A | A |
| Comparative Example 3 | >4 mm | C | C | C |

The details of the evaluation results shown in Table 2 are as follows.

(Castability)

A: The viscosity of the molten salt was low, and the casting could be performed while keeping good castability.

B: The viscosity of the molten salt was no problem, and the casting could be performed.

C: The molten salt was non-uniform and accompanied with noticeable lumps, thus showing poor castability.

(Collapsibility)

A: The salt core caused large cracks successively to be collapsed.

B: Small cracks occurred on the entire surface area of the core.

C: The core showed non-uniform collapsibility to result in a noticeable difference between collapsed part and non-collapsed part.

(Casting Surface)

A: The core surface exhibited few wrinkles and no problem.

C: The core surface exhibited some lumps of CaO and was rough.

Industrial Applicability

As is understood from the results shown in Table 2 above, according to the present invention, it has become possible to efficiently produce a casting core with good collapsibility by changing the shape of an alkaline earth metal oxide to be added as a collapse accelerator to a water-soluble-salt core comprising an alkali metal salt from a conventional powder form to particles having an appropriate particle size before the addition thereof.

The invention claimed is:

1. A casting core comprising:

a water-soluble alkali metal salt matrix; and alkaline earth metal oxide particles having an average particle size of 0.8-4 mm dispersed in the alkali metal salt matrix.

2. The casting core of claim 1, wherein the alkaline earth metal oxide comprises at least one oxide of calcium, magnesium and barium.

3. The casting core of claim 1, wherein the alkaline earth metal oxide comprises oxide of calcium.

4. The casting core of claim 1, wherein the water-soluble alkali metal salt comprises at least one species of chlorides, nitrates, and sulfates of sodium and/or potassium.

5. The casting core of claim 4, wherein the water-soluble alkali metal salt comprises a mixture of sodium chloride and potassium chloride.

6. The casting core of claim 1, wherein refractory particles other than alkaline earth metal oxide are dispersed in addition to the alkaline earth metal oxide particles.

7. A process for producing a casting core comprising a water-soluble alkali metal salt matrix and alkaline earth metal oxide particles having an average particle size of 0.8-4 mm dispersed in the alkali metal salt matrix, the process comprising:

dispersing alkaline earth metal hydroxide particles having particle sizes in a range of 1-5 mm in a melt of a water-soluble alkaline metal salt to convert them into alkaline earth metal oxide particles by dehydration; and casting the melt into a mold to cool and solidify the melt.

8. The process of claim 7, wherein a blend of alkaline earth metal hydroxide particles and a water-soluble alkaline metal salt in a particulate form is heated to melt the water-soluble alkaline metal salt, thereby forming a melt of the water-soluble alkaline metal salt in which the alkaline earth metal hydroxide particles or particles of alkaline earth metal oxide formed by dehydration of the alkaline earth metal hydroxide are dispersed.

9. A process for producing a casting core of claim 7, the process comprising:

obtaining alkaline earth metal hydroxide particles having particle sizes in the range of 1-5 mm by adding water to an alkali earth metal hydroxide or oxide to from a mixture;

kneading the mixture until the mixture forms a paste;

drying and solidifying the paste; and crushing and sieving the paste to recover a fraction of particles having appropriate sizes.

10. A casting method, comprising:

casting a molten metal into a mold in which a casting core according to claim 1 has been disposed;

cooling and solidifying the molten metal to form a cast metal object enclosing therein the casting core;

taking the cast metal object out of the mold; and causing the core to contact water to cause an expansion of the alkaline earth metal oxide particles due to conversion thereof into alkaline earth metal hydroxide particles and cause cracks in the alkali metal salt, thereby accelerating collapse and dissolution with the water of the casting core, and recovering cast metal object.

* * * * *